US005135460A

United States Patent [19]

Feustel

[11] Patent Number: 5,135,460

[45] Date of Patent: Aug. 4, 1992

[54] APPARATUS FOR CONTROLLING MACHINES FOR MAKING BAGS OR SACKS

[75] Inventor: Helmut Feustel, Cologne, Fed. Rep. of Germany

[73] Assignee: Windmoller & Holscher, Lengerich, Fed. Rep. of Germany

[21] Appl. No.: 586,776

[22] Filed: Sep. 24, 1990

[30] Foreign Application Priority Data

Sep. 25, 1989 [DE] Fed. Rep. of Germany ..... 3931967

[51] Int. Cl.[5] ..... B31B 23/10; B31B 23/98

[52] U.S. Cl. ..... 493/1; 493/29; 493/194; 493/204

[58] Field of Search ..... 493/1, 2, 24, 29, 194, 493/196, 204

[56] References Cited

U.S. PATENT DOCUMENTS 4,070,951 1/1978 Bala ..... 493/24

FOREIGN PATENT DOCUMENTS 2059630 4/1981 United Kingdom ..... 493/196

*Primary Examiner*—William E. Terrell

*Attorney, Agent, or Firm*—Fleit, Jacobson, Cohn, Price, Holman & Stern

[57] ABSTRACT

A machine for forming stacks of bags from a web of synthetic thermoplastic material has feeding rollers for feeding the web to welding jaws which form transverse welds in the web. There is a first motor for operating the feeding rollers and a second motor for operating the welding jaws. A central processing unit controls operation of the respective motors and includes a controller for the first motor for operating the first motor for an increased time and at a reduced speed during feeding of a leading bag in a stack as compared with the time and speed of operation of the first motor during feeding of remaining bags in the stack. This facilitates the removal of a previously formed stack of bags from a machine.

2 Claims, 4 Drawing Sheets

APPARATUS FOR CONTROLLING MACHINES FOR MAKING BAGS OR SACKS

BACKGROUND OF THE INVENTION

1. Field of the Invention

This invention relates to an apparatus for controlling a machine for making bags or sacks, which are severed by hot-wire welding from tubular or semitubular webs of synthetic thermoplastics, which machine comprises a pair of web-feeding rollers, which are driven by a motor directly or via a transmission, a pair of welding jaws, which serve to form seam welds, transverse seam welds or hot-wire-welded transverse seams in the web and are operable by a second motor via a transmission, and which machine optionally comprises additional processing means which are provided with drive means and may consist, e.g., of punching means, perforating knives and/or receiving means or stacking means, said apparatus comprising a central processing unit for controlling the motors so that the motor for the pair of welding jaws is energized at a time at which the motor for driving the pair of feed rollers is still energized and after a standstill period of the motor for the pair of feed rollers that motor is already energized before the motor for the pair of welding jaws has stopped.

2. Description of the Prior Art

An apparatus of that kind is known from European Patent Publication 297 434. In the known apparatus the drive means for the feed rollers and for the welding jaws can be decoupled so that the output rate of the machine can be increased because the standstill times will be independent of the feeding times and can be restricted to the actual welding times and because the operating times of the motors overlap each other in part so that a maximum output rate can be obtained and unproductive times can be avoided.

It is not always desired to operate the machine at the highest possible output rate. It may be suitable to operate the machine at an output rate which has been reduced in adaptation to other production means or to certain production sequences.

SUMMARY OF THE INVENTION

For this reason it is an object of the invention to provide an apparatus which is of the kind described first hereinbefore and which permits the machine to be operated at an output rate that is adjustable up to a maximum output rate.

In an apparatus of the kind described first hereinbefore that object is accomplished in accordance with the invention in that the speed of the pair of feed rollers is variable as desired for an increase or decrease of the time required to feed the web in a length corresponding to the length of a bag or sack.

For this reason the apparatus in accordance with the invention permits an operation of the bag- or sack-making machine at a higher or lower output rate in dependence on predetermined conditions or desired production sequences. Specifically, the output rate of the machine provided with an apparatus in accordance with the invention can be so controlled that the machine is operated at an increased or reduced output rate continuously or for shorter or longer periods of time and that the time of each cycle of the operation of the machine can be decreased or increased.

In bag- or sackmaking machines operating at a high output rate, it is difficult to remove the stacks of sacks or bags which have been made from the machine in such a manner that an interruption of the productive operation of the bag- or sack-making machine need not be interrupted in order to prevent subsequently made bags or sacks from interfering with the removal of a complete stack. It is known that bag- or sackmaking machines can so be controlled that they perform an unproductive cycle during the delivery of a stack. But expensive control means and a considerable intervention into the production process will be required in that case.

In accordance with a further feature, the time required to feed the web in a length corresponding to the length of a bag or sack can be increased to the time which is required for the removal of a stack consisting of a plurality of bags or sacks. As a result it is possible with the apparatus in accordance with the invention to effect during a correspondingly increased feeding time an undisturbed removal of a stack consisting of a predetermined number of bags or sacks, optionally after a previous treatment, such as blocking, and this can be accomplished without a standstill of the machine and without a need for unproductive cycles and without a need for an alternation of the production sequence in general.

DETAILED DESCRIPTION OF THE PREFERRED EMBODIMENTS

Figure 1:
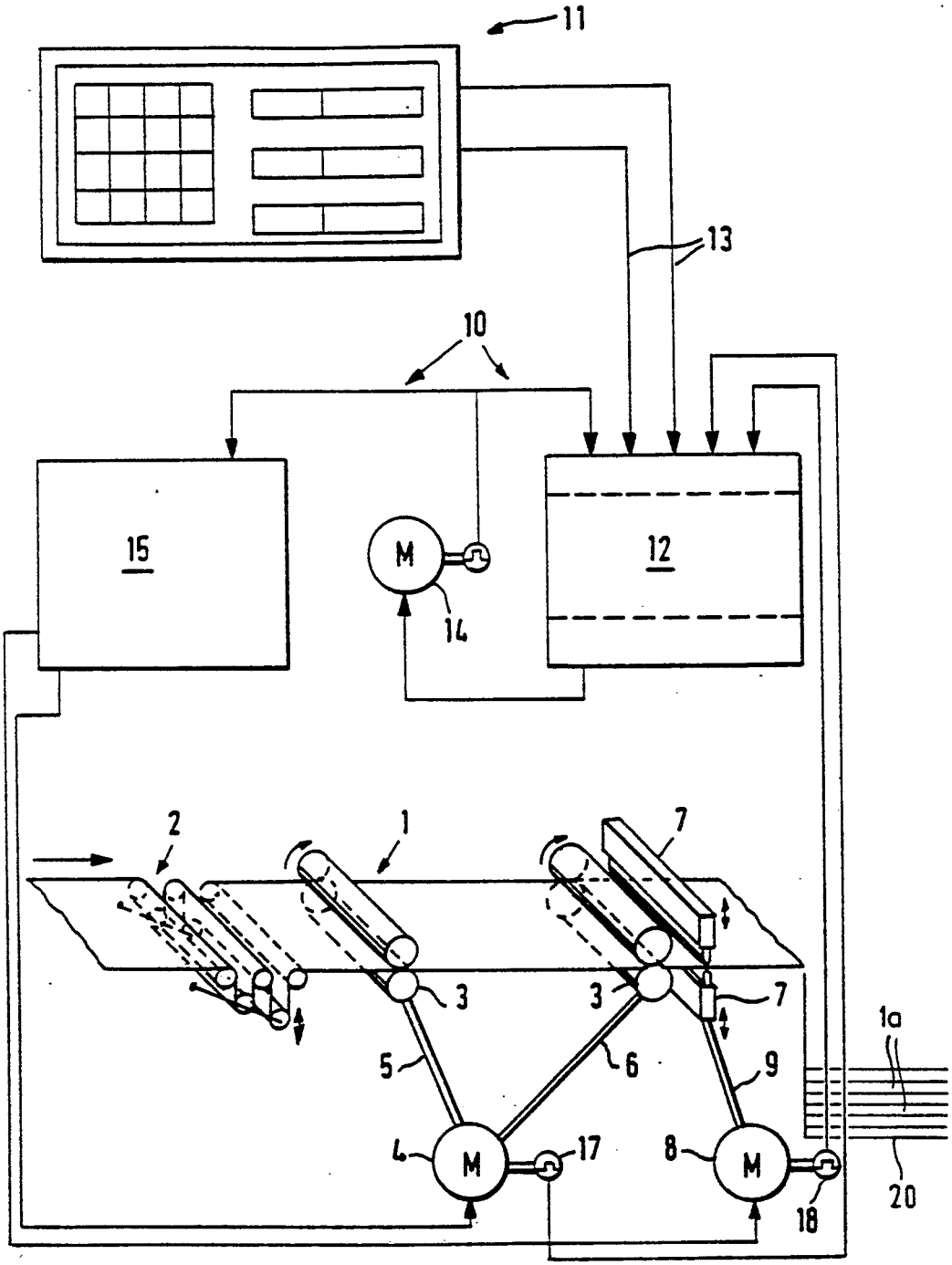
FIG. 1 is a diagrammatic view showing a bag- or sackmaking machine with associated control means.

An illustrative embodiment of the invention will now be described more in detail with reference to the drawing.

The machine 1 for making bags or sacks from a tubular or semitubular web comprises conventional web storage means 2, from which the web is intermittently withdrawn by the two pairs of feed rollers 3 in sections of predetermined length. The two pairs of feed rollers 3 are driven by a common motor 4 directly or via interposed transmission 5, 6.

A stepping motor 8 is provided for driving the welding jaws of the pair of welding jaws 7 in mutually opposite directions and is connected to the welding jaws 7 by conventional driving members 9.

A central processing unit 10 is provided, which controls the operation of the motors 4 and 8 during partly overlapping times. A keyboard 11 serves to input data into the central processing unit.

The central processing unit 10 may consist of a tiny microcomputer, which operates in dependence on properly prepared software.

Alternatively, the control unit 10 may consist of a central computer 12, which is provided by means of the data input means 11 via the data lines 13 with the required data, such as the feeding time, the welding time, and the number of cycles per minute.

In that case the central computer may determine speed of the master drive 14 and may control and monitor all functions of the machine at the same time.

The individual bags 1*a* severed from the web may be collected on a stacking means 20 in known manner.

If non-synchronous motors having a fast response are used as drive motors, the central computer will determine the speed and the position data of the welding jaw for a numerical control.

The master drive 14 may consist of a motor which operates at a speed that is determined by the central computer, and of an angular position encoder. If the motors consist of stepping motors the master drive may control an electronic drive controller 15 for delivering stepping pulses by which the step times of the stepping motors are determined. The stepping motors may be provided with position detectors 17, 18 for signalling the actual positions to the central computer. But stepping motors are only an example of the motors which may be employed. On principle, all motors which can be controlled may be used as drive motors.

Figure 2:
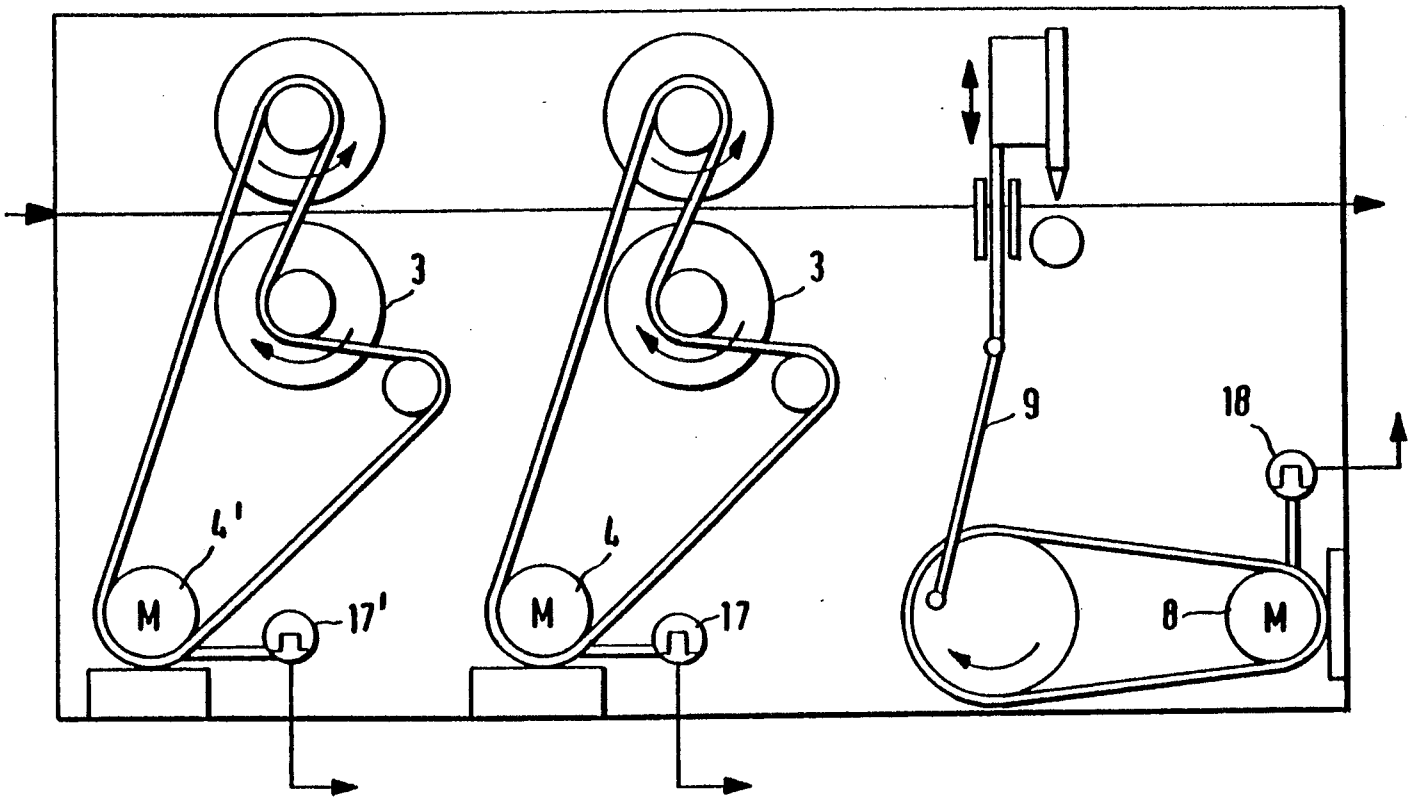
FIG. 2 is a diagrammatic side elevation showing separate motors for driving two pairs of feed rollers and the welding means.

In the embodiment shown in FIG. 2 the two pairs of feed rollers 3 are not driven by a common motor 4 via interposed transmissions 5 and 6, respectively, as is shown in FIG. 1, but each of said pairs of feed rollers is driven by an associated motor 4 and 4'. The use of two separate motors 4 and 4' for the two pairs of feed rollers eliminates the need for inflexible transmissions so that the two pairs of feed rollers can readily be operated at different speeds and the tension of the film web between the two pairs of feed rollers can easily be adjusted to the desired value. Each pair of feed rollers, the associated motors and power transmissions constitutes a unit which can easily be replaced in case of need.

Figures 3A, 3B, 3C, 3D:
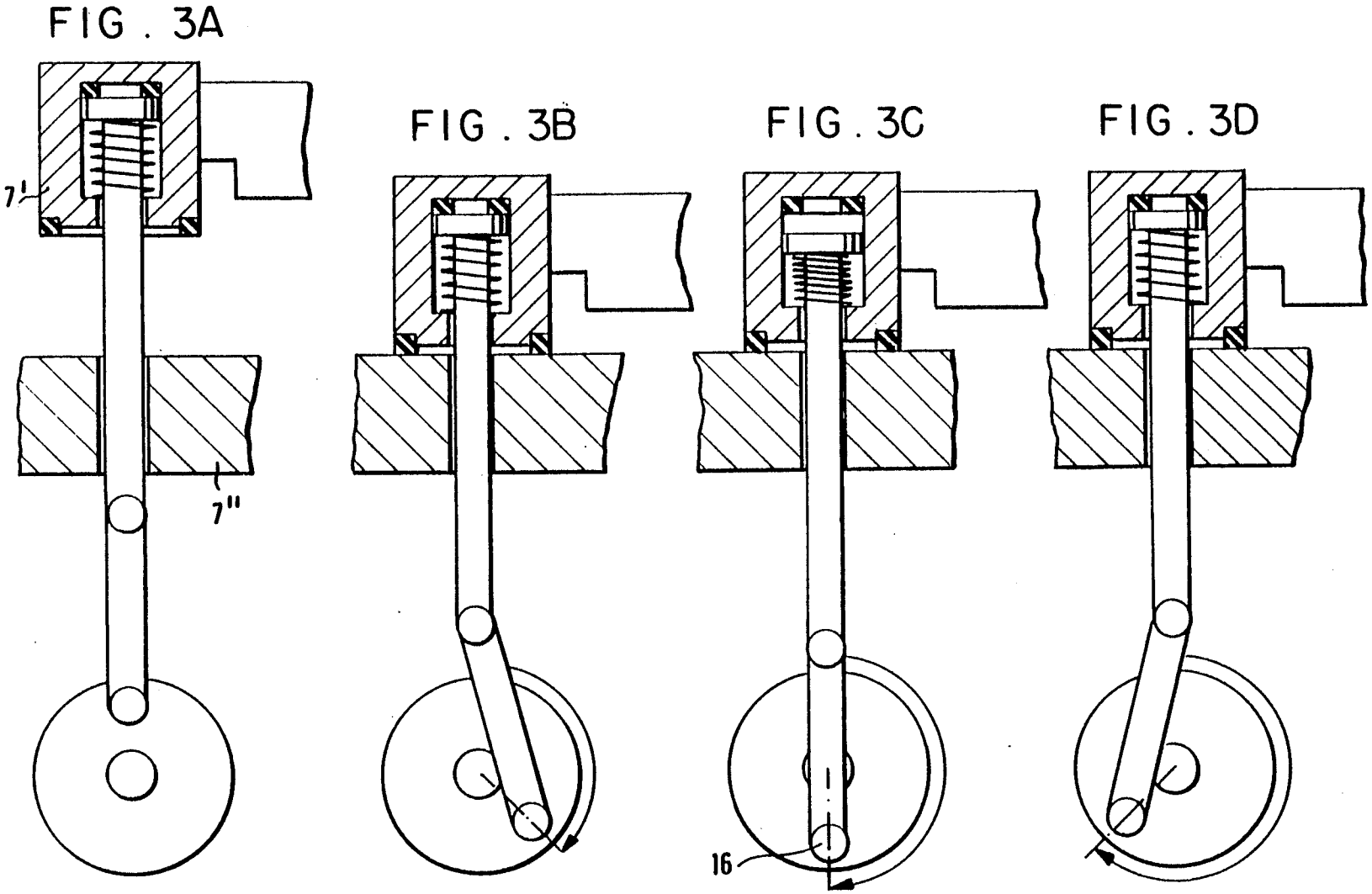
FIG. 3(A–D) is a diagrammatic side elevation showing crank drive for driving a welding jaw with the crank shown in various angular position.

FIG. 3 shows a welding jaw 7' which is driven by a crank drive, and cooperates with a stationary backing jaw or backing bar. In the first phase illustrated in FIG. 3 the upper welding jaw 7' has been lifted from the backing bar 7''. In the second phase the movable upper welding 7' has just been applied to the stationary backing bar 7''. In the third phase the crankpin 16 has reached its lower position whereas in the fourth phase it has reached the position in which the upper welding jaw 7' is just being lifted from the stationary backing member 7''. It is apparent that the second to fourth phases represent the time for which pressure is applied and the angular movement of the crank during the time of pressure application. It is apparent from FIG. 3 that the upper welding jaw 7' rests on the backing member 7'' during phases two to four, in which the crankpin 16 performs a predetermined angular movement so that pressure is applied as described.

In known machines an adjustable angular movement of the crankshaft was used for welding in each revolution of the crankshaft and the remainder of the revolution was used to lift and to re-apply the welding jaw. Each cycle of the machine corresponds to one revolution of the crankshaft. The angular movement during which pressure is applied is normally constant after the initial adjustment so that the actual welding time will always depend on the actual cycle frequency.

In accordance with the invention the drive motor 8 for operating the welding bar can so be controlled that, e.g., the speed of the motor 8 is increased and decreased during each revolution of the crankshaft so that the welding time, i.e., the time for which pressure is applied, will always equal the desired time and only the remaining angular movement performed during each revolution will be performed at a speed depending on the actual cycle frequency. It will also be possible so to control the motor 8 that the crankshaft is at a standstill for a short time. As a result, the time required by the crankpin 16 to perform a predetermined angular movement can be selected as desired.

The welding jaw might alternatively be moved by a linear drive. But the crank drive has the advantage that is permits of a simpler positioning, the motor can be operated at the highest possible speed for the movement through the "welding" position and a reversal of the motor for the reversal of the welding bar is not required. If a linear drive is employed, the "welding" position must be approached at a lower speed and an acceleration from standstill will be required for a movement in the opposite direction.

Figure 4:
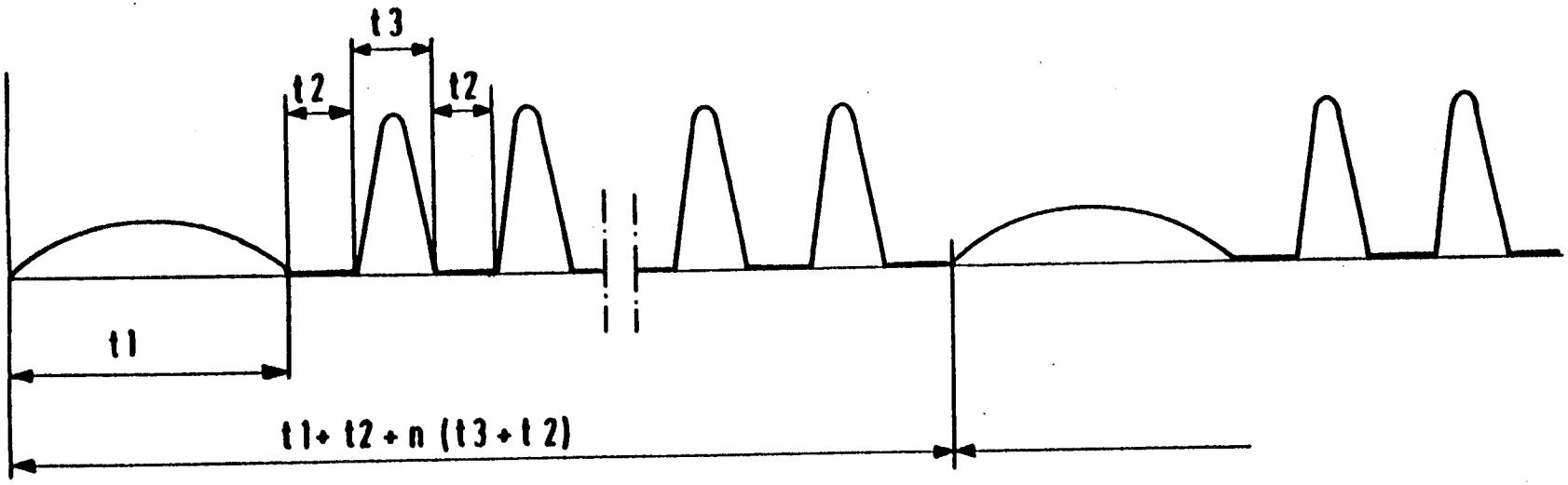
FIG. 4 is a speed-time graph from which the operating and standstill times of the pair of feed rollers during a stack-forming cycle are apparent.

From FIG. 4 showing a diagram representing the rotational or linear speed in dependence on time it is apparent that when a stack consisting of a predetermined number of bags or sacks has been formed the feeding time t1 provided for the feeding of the first bag of the next following stack will be sufficient for the removal of the previously formed attack. After the feeding time t1 for the first bag of the next following stack the feed drive is de-energized for a time t2, in which welding is performed and/or other processing operations are performed on the stopped bag or on the stopped corresponding web section. The feeding is then resumed for a relatively short time t3 and the feed lengths are the same, as is apparent from the graph. There is an alternation of standstill times t2 and feeding times t3 until a stack consisting of the selected predetermined number of bags has been formed. The time required for the formation of a complete stack of bags will thus be composed of the times $t1+t2+n(t3+t2)$.

Additional processing operations may be performed on the complete stack during the time t1. For instance, the stack of bags may be gripped by grippers and heated stacking pins for blocking the bags may subsequently be extracted from the stack of bags. The stack of bags is subsequently carried away or pulled off and the stacking table, which had been lowered in accordance with the height of the stack being formed, is lifted back to its uppermost position for receiving the next following bag as the first bag of a new stack.

It is apparent that a machine provided with the apparatus in accordance with the invention can be used to make a complete stack of bags, to remove the stack from the machine, and to prepare the stacking means for the formation of a new stack without a need for a stoppage of the entire production machine. During the slow step t1 the feeding speed is decreased only to the extent which is required. Because all processing and feeding means are individually driven and controlled, the synchronous performances of the entire production process is till ensured but a standstill of the entire machine during the removal of each stack is not required.

I claim:

1. A machine for making stacks of bags from a web of synthetic thermoplastic material comprising feeding rollers for feeding the web to a welding and severing means, welding jaws defining the welding and severing means for forming transverse welds in the web and severing individual bags successively from the web, stacking means for receiving the individual bags from the welding and severing means to form the individual bags into a stack, first motor means for operating the feeding rollers, second motor means for operating the welding jaws, and a central processing unit for controlling operation of the respective motor means including control means for the first motor means for operating the first motor means for an increased time and at a reduced speed during formation and feeding of a leading bag in a stack as compared with the time and speed of operation of the first motor means during formation and feeding of remaining bags in the stack thereby facilitating removal of a previously formed stack of bags from the attacking means.

2. A machine as claimed in claim 1 wherein the second motor means is connected to the welding jaws by a crank and the central processing unit includes means for varying the speed of the second motor means during each revolution of the crank.

* * * * *